United States Patent [19]

Sudhir

[11] 3,937,198

[45] Feb. 10, 1976

[54] ROLL-OVER VALVE AND VAPOR SEPARATOR

[75] Inventor: Gopinath Sudhir, Dearborn, Mich.

[73] Assignee: Chrysler Corporation, Highland Park, Mich.

[22] Filed: Jan. 24, 1974

[21] Appl. No.: 436,287

[52] U.S. Cl. ..... 123/136

[51] Int. Cl.[2] ..... F02D 19/00

[58] Field of Search ..... 123/136, 120

[56] References Cited

UNITED STATES PATENTS

| | | | |
|---|---|---|---|
| 3,352,294 | 11/1967 | Biller et al. | 123/136 |
| 3,370,578 | 2/1968 | Spelts | 123/136 X |
| 3,518,977 | 7/1970 | Smith | 123/136 |
| 3,614,960 | 10/1971 | Pfrengle | 123/136 X |
| 3,616,783 | 11/1971 | La Masters | 123/136 |
| 3,628,517 | 12/1971 | Soberski | 123/136 |
| 3,656,463 | 4/1972 | Kranc | 123/136 |
| 3,690,307 | 9/1972 | O'Neill | 123/136 |
| 3,752,134 | 8/1973 | Hollis, Jr. | 123/136 |
| 3,769,952 | 11/1973 | Fiedler et al. | 123/136 |

*Primary Examiner*—Charles J. Myhre
*Assistant Examiner*—Tony Argenbright
*Attorney, Agent, or Firm*—Talburtt & Baldwin

[57] ABSTRACT

A vacuum controlled valve either in series or parallel with the customary bleed orifice in the vapor flow path from the fuel tank to the charcoal canister of an automobile evaporative control system opens when the engine is operating to direct fuel vapor flow from the tank to the fuel-air inlet induction conduit, thereby to prevent excessive fuel vapor pressure in the tank that would otherwise be released to the atmosphere via the customary pressure vented closure cap for the fuel tank filler spout.

10 Claims, 4 Drawing Figures

ROLL-OVER VALVE AND VAPOR SEPARATOR

BACKGROUND AND SUMMARY OF THE INVENTION

In order to minimize fuel losses to the atmosphere by evaporation from the gasoline tank and other liquid fuel sources associated with an automobile engine, the fuel vapors are commonly vented to a charcoal canister for adsorption therein when the engine is not operating, and are vented from the canister to the engine fuel-air intake manifold when the engine is operating. In order to prevent entrainment of liquid fuel from the tank with the fuel vapors being vented to the canister, as for example when the automobile is driven along a steep incline or as a result of splashing when the automobile is driven over rough roads, the vent line customarily communicates with the fuel tank at an upper region thereof above the normal fuel level. In addition various types of vapor separators are employed to cooperate with the opening of the vent line or conduit into the fuel tank.

The vent line is customarily provided with an overflow limiting valve comprising a low pressure one-way check valve adapted to open when the pressure in the tank rises to about 8 or 10 inches of water above atomosphere. Accordingly after the tank is filled at the filling station pump to the level of the filler spout opening into the tank, the vapor pressure above the fuel level will increase rapidly as more fuel is added, causing the auomatic shut-off valve for the pump nozzle to be triggered before the overflow limiting valve opens, thereby preventing accidental overfilling of the tank. A small bleed orifice by-passes the overflow limiting valve to prevent collapse of the tank as fuel is consumed or in the event of a large drop in fuel tank vapor pressure.

When the automobile is driven on a hot day, the additional heat from the customary exhaust pipe that passes in proximity to the fuel tank causes such rapid fuel evaporation within the tank that the venting capacity of the vent line and overflow limiting valve is exceeded and an excessive fuel vapor pressure in the tank results, often amounting to more than 50 inches of water. In such an event, the pressure vented closure cap for the tank serves as a safety valve and vents fuel to the atmosphere to prevent damage to the fuel tank. However, venting to the atmosphere is obviously wasteful and a source of air pollution.

It is undesirable to increase the venting capacity of the overflow limiting valve to accommodate such emergency situations when the engine is operating because then the overflow limiting valve would also vent fuel vapors faster than could be adsorbed by the charcoal canister during frequently occurring high temperature summer time conditions when the engine is not operating. Accordingly, the venting capacity for the overflow limiting valve must be limited to the extent that it will restrict the vent flow to the charcoal canister to a predetermined maximum rate that can be effectively adsorbed by the canister, so as to avoid overloading the latter and discharging the fuel vapor to the atmosphere when the engine is not operating. In consequence the overflow limiting valve will effect a moderately high but safe vapor pressure within the fuel tank, which in turn will retard the rate of fuel evaporation and enable the use of a charcoal canister of convenient capacity.

An object of the present invention is to provide an improved and highly efficient automobile fuel tank vent means to the charcoal canister for maintaining the desired vapor pressure in the tank during conditions of normally to be expected high ambient temperatures when the engine is not operating, and for increasing the venting capacity to the extent necessary to prevent damage to the tank when the engine is operating at unusually high ambient temperatures.

Another object is to provide such a vent means whereby when the engine is operating, the fuel tank vapors are vented either directly or via the charcoal canister to the fuel-air intake manifold for the engine and burned therein.

Other objects of this invention will appear in the following description and appended claims, reference being had to the accompanying drawings forming a part of this specification wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

DESCRIPTION OF THE PREFERRED EMBODIMENT

Figure 1:
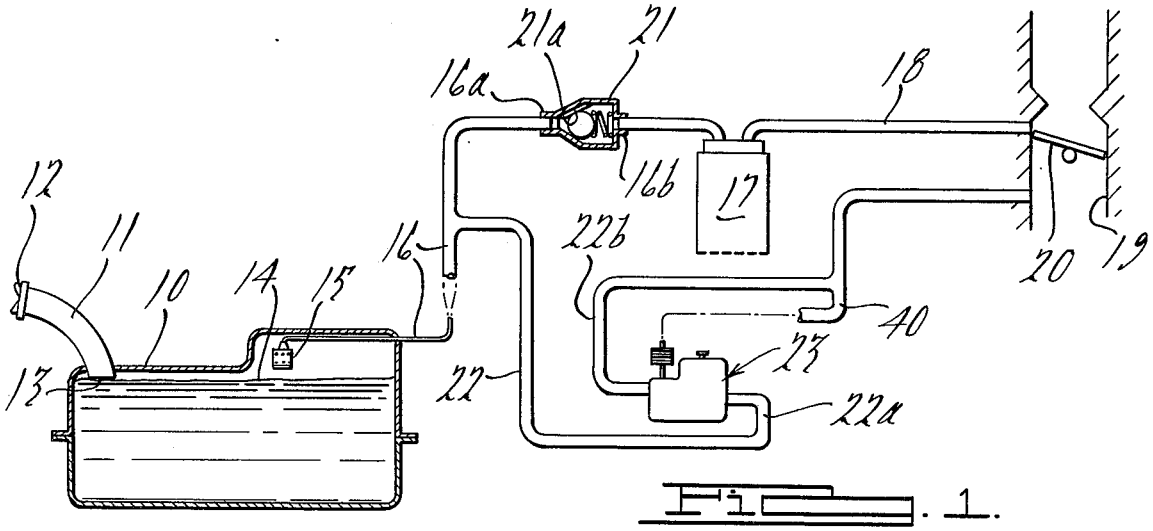
FIG. 1 is a schematic sketch of an automobile fuel tank vent systemm embodying the present invention.

FIG. 1 shows a typical automobile gasoline fuel tank 10 having a filler spout 11 closed by a removable outer cap 12. The spout 11 opens into an upper location 13 of the tank 10 and determines the normal maximum fuel level 14 in the tank as explained below. Also secured within the tank 10 above the maximum fuel level 14 is a vapor separator 15 through which fuel vapor may be vented via vent line or conduit 16 to the upper end of a charcoal filled canister 17. The latter is open at its opposite lower end to the atmosphere. The upper end of the canister 17 is also connected by conduit 18 to the low pressure of the fuel-air intake mainfold 19 of the engine, as for example adjacent or downstream of the leading edge of the throttle valve 20.

A one-way check valve or overflow limiting valve 21 in vent conduit 16 restricts the venting of vapors from the tank 10 until the pressure therein attains a predetermined low value of approximately 8 to 10 inches of water, for example when the engine is not operating. Conduit 16 comprises an upstream portion **16*a* between the tank 10 and valve 21, and a downstream portion 16*b* between the valve 21 and canister 17. When a gasoline station nozzle equipped with an automatic pressure operated shut-off valve is inserted into spout 11, the tank 10 may be filled to the level 14. During the filling operation, air and fuel vapors are exhausted from the tank via spout 11. When the fuel level reaches opening 13, the escape of gas via spout 11 is blocked and the tank pressure rises by virtue of the check valve 21, causing the gasoline station nozzle to shut off at the fuel level 14 slightly above the level of opening 13**.

The cap 12 is then secured in place to close the tank 10. Diurnal heating of the tank 10 may increase the vapor pressure therein sufficiently to open valve 21 and discharge fuel vapors into canister 17 where the vapors are stored by adsorption if the engine is not operating. When the engine is operating, engine manifold vacuum will purge the canister 17 of previously stored fuel vapor by fresh air flow therethrough via its open lower end and thence through conduit 18 to the intake manifold 19. During this operation, the lower canister opening to atmosphere prevents the low manifold pressure in line 18 from being conducted significantly to line 16.

Check valve 21 may be provided with a vapor bleed slot 21*a* that permits a slow vapor bleed in either direction through valve 21 even when the latter is closed. Thus when the liquid fuel level 14 gradually lowers as fuel is conducted from the tank to the engine during operation, a sub-atmospheric pressure in tank 10 and possible collapse of the latter are avoided. The operation and function of the structure described thus far may be conventional and are accordingly not discussed in further detail.

Figure 2:
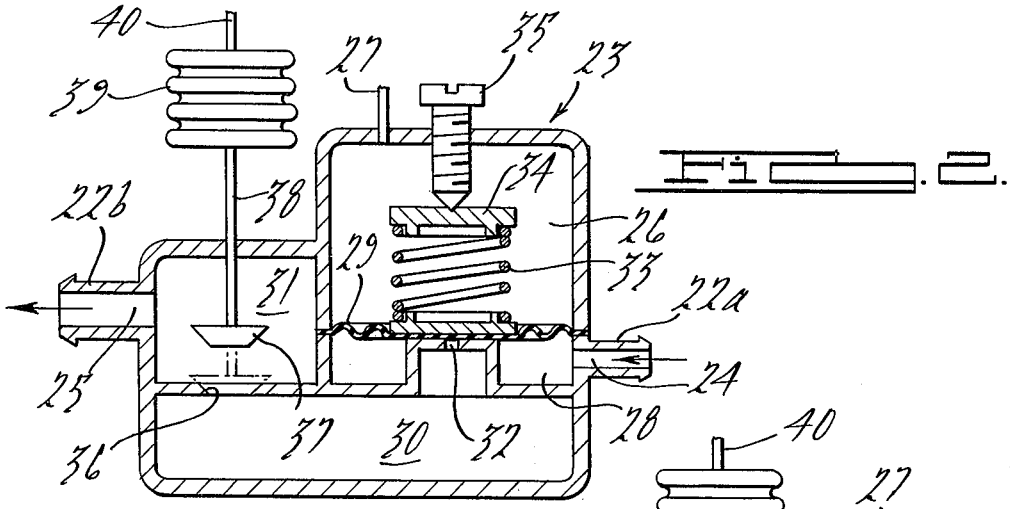
FIG. 2 is an enlarged schematic view of the pressure actuated valve employed in FIG. 1.

The vent means of the present invention also comprises a bypass conduit 22 controlled by a normally closed control valve 23, FIG. 2. The conduit 22 has a portion 22*a* communicating between an inlet port 24 of the valve 23 and the vapor in tank 10 via by way of example a portion of conduit 16*a*. A second portion 22*b* of conduit 22 communicates between an outlet port 25 of valve 23 and the induction manifold or conduit 19 at a location by way of example downstream of the throttle valve 20.

The valve 23 comprises several chambers including a chamber 26 in communication with the atmosphere via vent 27, pressure chamber 28 having inlet port 24 opening thereinto and being separated from chamber 26 by a movable wall or flexible disphragm 29, chamber 30 and chamber 31, the latter being in communication with outlet port 25. A restricted port 32 normally closed by diaphragm 29 provides communication between chambers 28 and 30 when the vapor pressure in conduit 22*a* and tank 10 exceeds a predetermined valve of for example 5 or 10 inches of water sufficient to move diaphragm 29 upward against the closing force of a spring 33 seated between diaphragm 29 and an adjustable retainer 34. Screw 35 accessible exteriorly of chamber 26 adjusts the position of retainer 34 and the closing force of spring 33 to determine the tank vapor pressure required to open port 32. The latter pressure may be the same or lower than the pressure required to open valve 21.

A comparatively unrestricted port 36 normally closed by valve 37 provides communication between chambers 30 and 31 when the automobile engine is operating to induce a low pressure in manifold or conduit 19. In this regard valve 37 is connected by plunger 38 to the lower movable wall of a resilient bellows 39. The plunger 38 extends slidably in fluid sealing relationship through a wall of chamber 31. The interior of the bellows 39 is in communication via duct 40 and a portion of duct 22*b* by way of example with manifold 19. Although both conduit 40 and port 25 communicate with manifold 10 downstream of throttle 20, either could communicate with manifold 19 at any desirable location, as for example in the manner of conduit 18.

Conversely conduit 18 could communicate with manifold 19 at any convenient location.

By virtue of the connections shown, conduit 18 will be in the nearly atmospheric pressure region of manifold 19 and conduit 22*b* will be in the latter's low sub-atmospheric pressure region when the engine is operating with the throttle at its closed or idle position shown. As the throttle 20 opens, the pressure at conduit 22*b* will rise but will still be substantially sub-atmospheric until the throttle 20 is wide open.

It is also apparent that as the throttle 20 opens from the closed or idle position shown, its leading edge will move above the opening of conduit 19 into the manifold 19 and the pressure in conduit 18 will fall rapidly. Thus at moderately open throttle positions ranging from fast idle to cruise and moderate load conditions, the pressure in conduit 18 will be sub-atmospheric. Upon continued opening of the throttle 20 from the cruise position, the manifold pressure downstream of the throttle valve 20 will gradually increase but will always be sub-atmospheric.

Referring again to FIG. 2 when the engine is not operating, both conduits 18 and 22*b* will communicate with atmospheric pressure in manifold 19, enabling the resilient bellows to hold valve 37 at the closed position shown in phantom. It will then be immaterial whether or not the tank vapor pressure is suffficient to raise diaphragm 29 and open port 32. A small fuel vapor flow from tank 10 will be accommodated by bleed port 21*a* into the charcoal canister 17. If the vapor pressure in tank 10 should increase beyond the capacity of bleed port 21*a*, valve 21 will open. The vapor flow from tank 10 will be adsorbed by the charcoal in canister 17 to prevent air pollution.

Subsequently, when the engine is operating and the throttle valve 20 is open beyond the idle position shown (except at the wide open position) the low pressure in manifold 19 will induce fresh air flow into canister 17 through the latter's open bottom, such that previously stored fuel vapors in the canister 17 will be entrained with the fresh air via conduit 18 into the manifold 19 and thence to the engine where the fuel vapors are burned. In consequence the canister 17 is purged of fuel vapors and made ready to receive evaporative fuel losses from tank 10 on the next occasion that the engine is not operating.

When the engine is operating with the throttle at any position including the idle position shown (except at wide open throttle) the low pressure of manifold 19 transmitted via conduits 22*b* and 40 will actuate bellows 39 to open port 36. If the fuel vapor pressure in tank 10 applied via conduit 22*a* and port 24 to diaphragm 29 is adequate to open port 32, the primary vapor flow will then be directly through port 36 and conduit 22*b* into manifold 19, rather than into the canister 17, although some fuel vapor may flow via valve 21 to the canister 17 and thence to manifold 19 while the engine is operating. By virtue of the restricted orifice 32 and the connection via bleed 21*a* and canister 17 to the atmosphere, if diaphragm 29 should stick in the raised or open position, the total vacuum of manifold 19 will not be applied to collapse tank 10. Also the vent 27 and bleed 21*a* provide parallel independent paths to the atmosphere to prevent an excessive high tank pressure during engine operation in the event diaphragm 29 should crack or rupture. In consequence a simple closure cap 12 may be substituted for the usual combination pressure vented and pressure relief valve otherwise required for cap 12.

Figure 3:
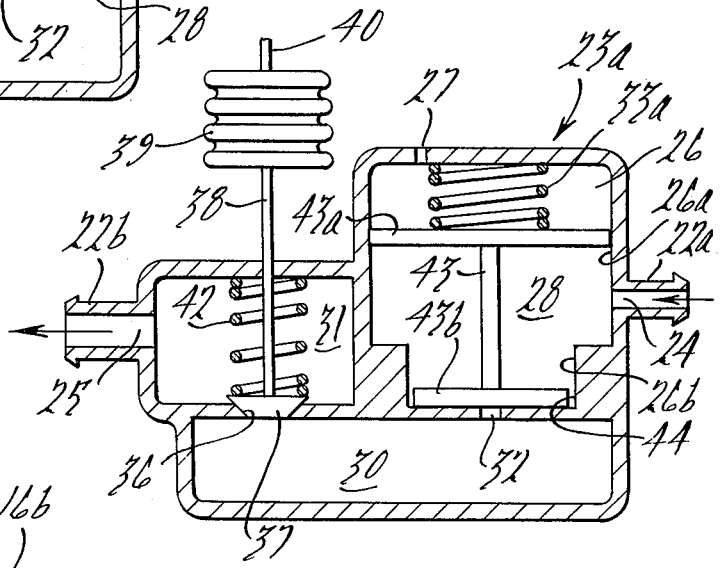
FIG. 3 is a view similar to FIG. 2, showing a modification.

FIG. 3 shows a valve 23*a* which may replace valve 23 in the FIG. 1 circuit, wherein corresponding parts in FIGS. 2 and 3 are identified by the same numbers. The valve 37 is urged to its seated position by a spring 42 which may supplement the resiliency of bellows 39. Instead of diaphragm 29, a differential area poppet type plunger 43 is employed to space and connect a large area piston 43*a* with a smaller area piston 43*b*. Piston 43*a* reciprocates in fluid sealing relationship within a cylinder portion 26*a* of chamber 26. Piston 43*b* normally closes port 32 and reciprocates within an oversize cylinder portion 26*b* of chamber 26, thereby to provide an annular leakage path 44 for vapor between chambers 26 and 30 via bleed port 32 when piston 43*b* is unseated from port 32.

Spring 33*a* under compression between an upper wall of chamber 26 and piston 43*a* normally urges the plunger 43 downward, thereby to cause piston 43*b* to close port 32. Vapor pressure in chamber 28 via duct 22*a* is applied against the larger undersurface of piston 43*a* and the smaller upper surface of piston 43*b*. By reason of the area differential, at a predetermined vapor pressure of for example 8 or 10 inches of water, the larger pressure force applied against area 43*a* will exceed the combined force of spring 33*a* and the pressure force against 43*b*, causing piston 43*b* to move upwardly and unseat from port 32 to open the latter. The pressure at both sides of piston 43*b* will then tend to equalize via annular passage 44, causing the plunger 43 to pop to a wide open position. A positive opening of port 32 in FIG. 3 is achieved, as compared to the nearly linear opening of port 32 with increasing pressure in FIG. 2. In other respects, the valve 23*a* operates in the manner of valve 23.

Figure 4:
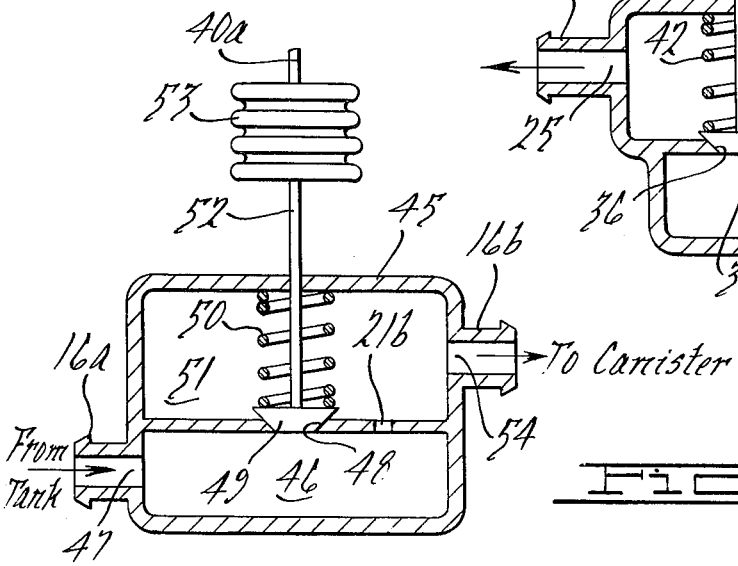
FIG. 4 is an enlarged schematic view showing another modification of the invention.

FIG. 4 illustrates a modification wherein the bypass conduit 22 is eliminated and a control valve 45 replaces valve 21 in conduit 16. Valve 45 comprises a pressure chamber 46 having an inlet port 47 in communication with tank 10 to receive fuel vapors therefrom via the upstream conduit 16*a*, an unrestricted port 48 normally closed by a vacuum actuated valve plunger 49, and an overflow limiting bleed port 21*b* which serves in the manner of bleed port 21*a*. Valve plunger 49 is normally urged to the illustrated closed position by spring 50 seated against a fixed wall portion of a second chamber 51 of valve 45 and is connected to a plunger rod 52 which extends slidably in fluid sealing relationship through the latter wall portion and is connected to the movable lower wall of a bellows 53 exteriorly of chamber 51. The interior of the bellows 53 is connected by conduit 40*a* to the induction manifold 19, preferably downstream of the throttle valve 20 in the manner of conduit 40.

Chamber 51 is also connected via outlet port 54 with the downstream conduit 16*b* and thence with canister 17. When the engine is operating, low pressure in manifold 19 actuates bellows 53 to move plunger 52 upward and unseat valve 49 from port 48 to establish a comparatively low resistance flow path from the upper portion of tank 10 to canister 17, whereby excessive fuel vapor pressure cannot develop in tank 10. As fast as fuel vapors flow into canister 17, they are entrained in the above described fresh air flow through the canister 17 and into induction conduit 19.

When the engine is not operating, the resulting atmospheric pressure in conduit 40*a* enables the bellows 53 to expand and return valve plunger 49 to the closed position shown, as urged by spring 50. Thereafter fuel vapors will flow to canister 17 only via restricted port 21*b*.

In this latter regard, it is to be noted that when the engine is not operating, the fuel tank 10 will not be subject to the intense heat of the exhaust pipe that might otherwise add to fuel tank heating when the engine is operating. Accordingly fuel vapor pressure in tank 10 will not be as great as when the engine is operating and may be accommodated by bleed port 21*b* without creating an excessive fuel tank pressure. The FIG. 4 construction thus provides an economical compromise that directs excess fuel tank vapors to the induction manifold via the charcoal canister 17 when the engine is running.

I claim:

1. In an automobile engine having a fuel tank and an intake manifold for supplying fuel and air to said engine, the combination of vapor storage means, vent conduit means for venting fuel vapors to said storage means from said tank, said vent conduit means including bypass conduit means for providing a restricted vapor flow path bypassing said storage means, control means for controlling vapor flow through said vent conduit means from said tank comprising valve means in said bypass conduit means movable between open and closed positions, means for normally moving said valve means to said closed position to close said bypass conduit means, and pressure actuated means responsive only to a predetermined, sub-atmospheric pressure in said intake manifold and a simultaneous vapor pressure in said tank greater than a predetermined comparatively low pressure above atmospheric for moving said valve means to open said bypass conduit means to establish communication therethrough between said tank and intake manifold.

2. In the combination according to claim 1, bleed means comprising a restricted orifice in said vent conduit means bypassing said valve means for providing a restricted flow path for said vapors when said bypass conduit means is closed by said valve means.

3. In the combination according to claim 2, said vapor storage means having an air inlet in communication with the atmosphere and also having a purge outlet, and means for purging fuel vapors from said storage means comprising purge conduit means for connecting said purge outlet with sub-atmospheric pressure of said intake manifold for inducing gas flow through said vapor storage means from said inlet to said outlet and into said intake manifold when said engine is operating.

4. In the combination according to claim 1, said valve means comprising first valve means cooperable with said pressure actuated means to be moved to its open position thereby in response to said predetermined sub-atmospheric pressure and also comprising second valve means cooperable with the first valve means for normally closing said bypass conduit means when at least one of said valve means is closed and being cooperable with said pressure actuated means to be moved to its open position thereby in response to said simultaneous vapor pressure, to establish communication between said tank and said intake manifold through said bypass conduit means when both valve means are open.

5. In the combination according to claim 1, said vent conduit means comprising a first conduit means in communication with said storage means for venting fuel vapor thereto from said tank and a second conduit means comprising said bypass conduit means, said first conduit means having restricting means for restricting the same to limit the rate of vapor flow from said tank to said storage means.

6. In the combination according to claim 5, means for purging said storage means of fuel vapor stored therein comprising an air inlet in communication with the atmosphere and a purge outlet in communication with said manifold for inducing air flow through said storage means from said air inlet to said purge outlet and thence into said intake manifold during operation of said engine.

7. In the combination according to claim 4, said second valve means comprising a pressure chamber having an inlet port and an outlet port and, defining portions of said bypass conduit means, movable means defining a movable wall portion of said chamber and having a valve element normally closing one of said ports, said movable means being responsive to vapor pressure in said tank in excess of a predetermined small value above atmospheric for moving said valve element to open said one port to establish comunication in said bypass conduit through said chamber.

8. In the combination according to claim 7, said chamber being in communication with said tank via said inlet port, and said one port normally closed by said valve element comprising said outlet port.

9. In the combination according to claim 7, said movable wall portion exteriorly of said chamber being in restricted communication with the atmosphere.

10. In the combination according to claim 9, said vent conduit means comprising a first conduit means in communication with said tank and storage means for venting fuel vapor to the latter from said tank and a second conduit means comprising said bypass conduit means, one-way check valve means normally closing said first conduit means and responsive to a predetermined small pressure in said tank above atmospheric for opening said first conduit means, and bleed means for providing a restricted rate of vapor flow through said first conduit means from said tank to said storage means.

* * * * *